US010875751B2

(12) United States Patent
Marrale

(10) Patent No.: US 10,875,751 B2
(45) Date of Patent: Dec. 29, 2020

(54) PUMPING MACHINE

(71) Applicant: DIMACO S.A.S. DI MARRALE CARMELO & C., Gela (IT)

(72) Inventor: Carmelo Marrale, Gela (IT)

(73) Assignee: DIMACO S.A.S. DI MARRALE CARMELO & C., Gela (IT)

( * ) Notice: Subject to any disclaimer, the term of this patent is extended or adjusted under 35 U.S.C. 154(b) by 439 days.

(21) Appl. No.: 15/765,972

(22) PCT Filed: Oct. 6, 2016

(86) PCT No.: PCT/IB2016/055976
§ 371 (c)(1),
(2) Date: Apr. 4, 2018

(87) PCT Pub. No.: WO2017/064596
PCT Pub. Date: Apr. 20, 2017

(65) Prior Publication Data

US 2018/0290869 A1 Oct. 11, 2018

(30) Foreign Application Priority Data

Oct. 13, 2015 (IT) ..... 102015000061232

(51) Int. Cl.
*B66F 3/10* (2006.01)
*B66F 3/24* (2006.01)
(Continued)

(52) U.S. Cl.
CPC ..... *B66F 3/10* (2013.01); *B66F 3/247* (2013.01); *B66F 3/28* (2013.01); *B66F 3/44* (2013.01);
(Continued)

(58) Field of Classification Search
CPC .... B66C 23/80; B66F 1/08; B66F 1/10; B66F 1/24; B66F 1/247; B66F 1/25; B66F 1/28; B66F 1/44; B66F 7/16; B66F 7/28
(Continued)

(56) References Cited

U.S. PATENT DOCUMENTS 1,361,909 A * 12/1920 Schoenknecht ..... B66D 3/18 254/93 R
2,508,587 A 5/1950 Turchan et al.
(Continued)

FOREIGN PATENT DOCUMENTS

CN 101423184 A 5/2009
DE 102010036036 A1 3/2012
(Continued)

OTHER PUBLICATIONS

International Search Report and Written Opinion issued in PCT/IB2016/055976, dated Jan. 20, 2017; ISA/EP.

*Primary Examiner* — Joseph J Hail
*Assistant Examiner* — Arman Milanian
(74) *Attorney, Agent, or Firm* — Harness, Dickey & Pierce, P.L.C.

(57) ABSTRACT

Pumping machine (650, 750) comprising: —at least two tubular elements (651, 751) containing pressurized gas and extending vertically in parallel and interconnected between them by means of a connecting element (652, 752); and—an electromechanical lifting system (600, 700) comprising a first cylinder (601, 701), interconnected to the tubular elements (651, 751) and comprising a substance compressible by a piston (601*b*, 701*b*); and a screw (602, 702) with a vertical axis Y coinciding with the axis of the pumping machine (650, 750). The screw (602, 702) is inserted inside a second thrust cylinder (658, 758), connected in sliding manner inside the first cylinder (601, 701), and has a first end (602*b*, 702*b*) fixed to the connecting element (652, 752)
(Continued)

and a second end (602*a,* 702*a*) configured for sliding inside the thrust cylinder (658, 758) and overlying a chamber (605, 705) comprising lubrication and cooling oil overlying the piston (601*b,* 701*b*).

12 Claims, 12 Drawing Sheets

(51) Int. Cl.
*B66F 3/28* (2006.01)
*B66F 3/44* (2006.01)
*F04B 47/14* (2006.01)
*F04B 47/00* (2006.01)

(52) U.S. Cl.
CPC ..... *F04B 47/00* (2013.01); *F04B 47/14* (2013.01); *F04B 47/145* (2013.01)

(58) Field of Classification Search
USPC ..... 254/100, 105, 89 H, 92, 93 A, 93 R; 60/372; 92/136
See application file for complete search history.

(56) References Cited

U.S. PATENT DOCUMENTS 2,560,285 A * 7/1951 Habenicht ..... F04B 47/00 60/372
2,572,748 A * 10/1951 Noll ..... F04B 47/00 60/372
2,728,193 A * 12/1955 Bacchi ..... F04B 47/02 60/372
2,874,641 A * 2/1959 McCandlish ..... F04B 47/04 166/62
2,887,846 A * 5/1959 Habenicht ..... F04B 47/04 60/372
2,934,319 A 4/1960 Wahlstrom
3,777,491 A * 12/1973 Bender ..... F15B 1/26 60/372
3,823,758 A 7/1974 Heese
3,904,177 A * 9/1975 Dalton ..... B66F 3/16 254/103
4,098,491 A * 7/1978 Larralde ..... E21B 19/09 60/393
4,848,085 A * 7/1989 Rosman ..... E21B 43/127 60/372
4,865,293 A 9/1989 Ishi et al.
5,238,087 A * 8/1993 Garrido ..... B66B 17/12 187/253
7,490,674 B2 * 2/2009 Brecheisen ..... E21B 43/126 166/369
7,584,784 B2 * 9/2009 Wagner ..... E21B 43/127 166/105
9,745,975 B2 * 8/2017 Dancek ..... F04B 49/065
2008/0277208 A1 * 11/2008 Barone ..... B66F 7/02 187/273
2012/0256146 A1 10/2012 Arnold et al.
2013/0306326 A1 * 11/2013 Doyle ..... E21B 43/128 166/369

FOREIGN PATENT DOCUMENTS

FR 1359856 A 4/1964
IT CZ2014000007 4/2014
JP H033896 A 1/1991
JP H0899796 A 4/1996
KR 101446550 B1 10/2014

* cited by examiner

PUMPING MACHINE

CROSS REFERENCE TO RELATED APPLICATIONS

This application is a U.S. National Phase Application under 35 U.S.C. 371 of International Application No. PCT/IB2016/055976 filed on Oct. 6, 2016 and published in English as WO 2017/064596 A1 on Apr. 20, 2017. This application claims the benefit of priority from Italian Patent Application No. 102015000061232 filed Oct. 13, 2015. The entire disclosures of all of the above applications are incorporated herein by reference.

The present invention relates to a pumping machine.

In particular, the present invention relates to a pumping machine, of the type comprising an electromechanical lifting system for lifting a load.

As it is known, a pumping machine is a working machine that uses mechanical handled parts (rotating or in linear motion) to lift or otherwise move or collect fluid material. This type of pumps is indicated for dripping from drilled wells having a considerable depth. Cylinders, for example hydraulic cylinders, are usually used in the mechanical parts of such machines for exploiting the pressure of fluids supplied by a pump for the transmission of forces. These hydraulic or pneumatic cylinders have the advantage of being of simple and economical construction and of accumulating and reusing energy by means of special pressure containers, but only when their application requires low precision on the repeatability of the handling speed and low positioning precision.

Instead, when the application requires high force control, speed and positioning, mechanical cylinders based on the use of fluid pressure need very expensive units for the production, control and distribution of the pressurized fluid.

Therefore, normally in these cases it is preferred to use electronically controlled motion transmission systems, which ensure high control of speed and positioning.

However the electrical systems are difficult to accumulate the energy and effectively reuse it.

A solution to this problem has been proposed in the patent application ITCZ20140007 filed on Apr. 14, 2014 and assigned to DIMACO SAS that describes an electromechanical load lifting system comprising a cylinder comprising a screw connected to the load that can translate vertically to descent and ascend; an electric motor connected to one end of the cylinder; and means for transferring rotational motion imparted by the electric motor into translational movement of the screw. The cylinder also comprises a tank filled with compressible gas and a piston connected to one end of the screw. Substantially the translational movement of the screw allows the piston to transfer energy to the gas of the tank, when the screw is directed towards the tank, and from the gas to the screw, when this is directed in the opposite direction. Furthermore, as shown in FIG. 1, it is described a ground machine for artificial lift of oil from subsoil wells by means of pumping rods comprising the lifting system and comprising two tubular elements, extending vertically and parallel between them, containing pressurized gas, interconnected at the top by a bracket and inferiorly fastened to a support frame. The tubular elements laterally comprise sliding and anti-rotation guides to which the screw of the electro-mechanical lifting system is coupled by an axle, rigidly connected to the end of the screw, at whose ends are bound sliding means for sliding on the guides and rolling means for supporting a cable connecting the machine to well pumping rods.

Although convenient in several respects, especially concerning the energy efficiency, this machine has the problem of having a limited effectiveness, due to the fact that both the load of the gas and that one of the engine simultaneously affect both the motor nut and the screw. This overload of the nut will cause overheating and, therefore, premature aging.

Moreover, being also the screw subjected to the whole load, it is necessary to restrict its length, and hence its useful stroke. For these reasons, the machine of the previous patent application of the Applicant neither can lift big loads nor has a sufficiently long service life.

Scope of the present invention is to provide a pumping machine, of the type comprising an electromechanical lifting system, able to lift, for the same screw diameter, a heavy load, at least twice compared to the previous patent application of the same Applicant, obtaining a longer useful life, of at least three times or more, compared to the previous patent application of the same Applicant, thus having characteristics that exceed the limits which still affect the machines previously described with reference to the known technique.

According to the present invention, a pumping machine is provided, as defined in claim 1.

For a better understanding of the present invention a preferred embodiment is now described, purely by way of non-limiting example, with reference to the accompanying drawings, in which.

Figure 1A:
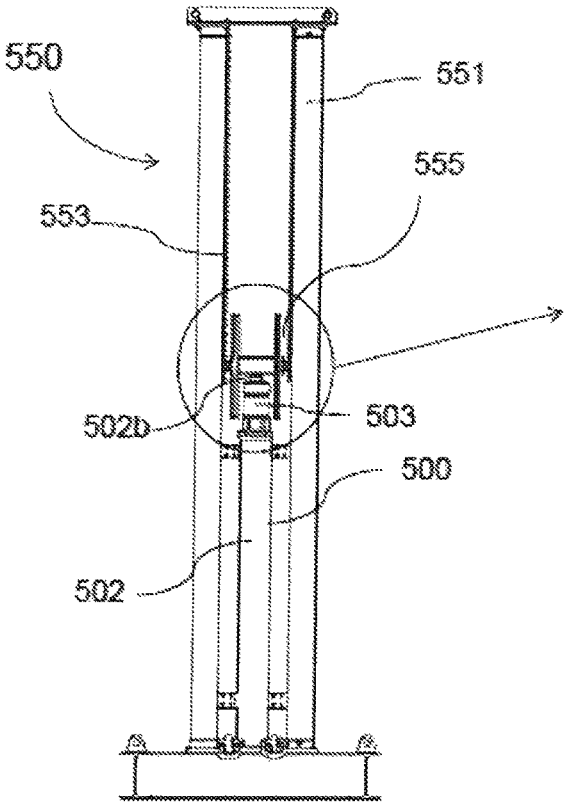
FIG. 1 shows a schematic view of a pumping machine and an enlarged detailed view of a specific part, according to prior art.
Figure 1B:
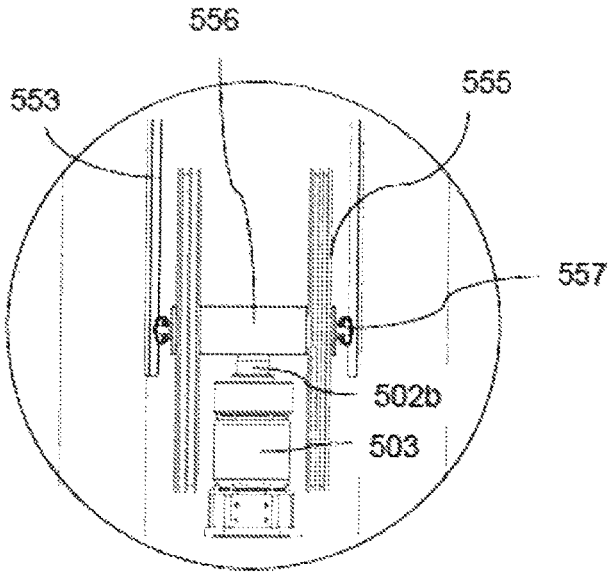
Fig.1B (PRIOR ART)
Figure 2:
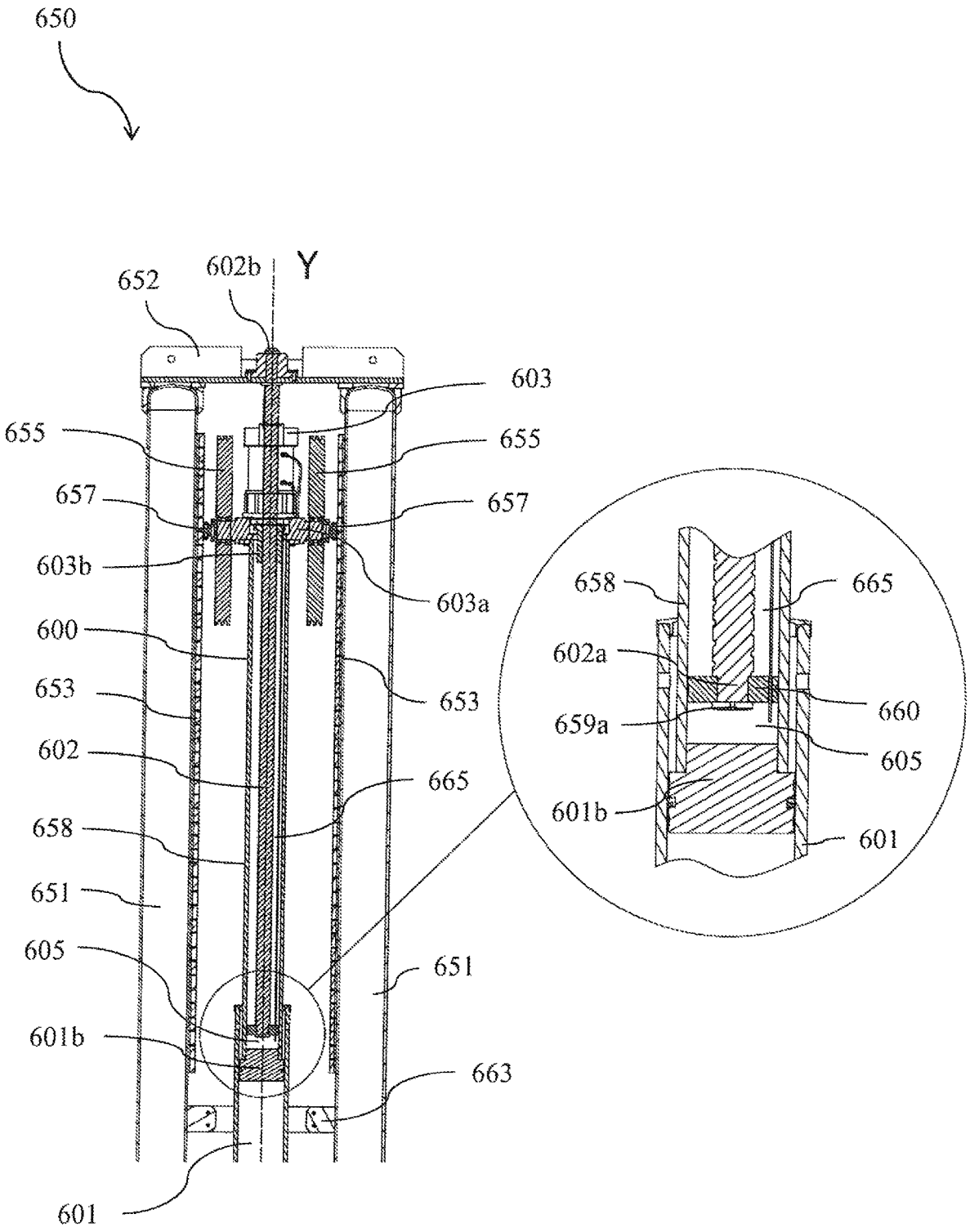
FIG. 2 shows a first schematic view of the upper part of a first embodiment of a pumping machine and an enlarged detailed view of it, according to the invention.
Figure 3:
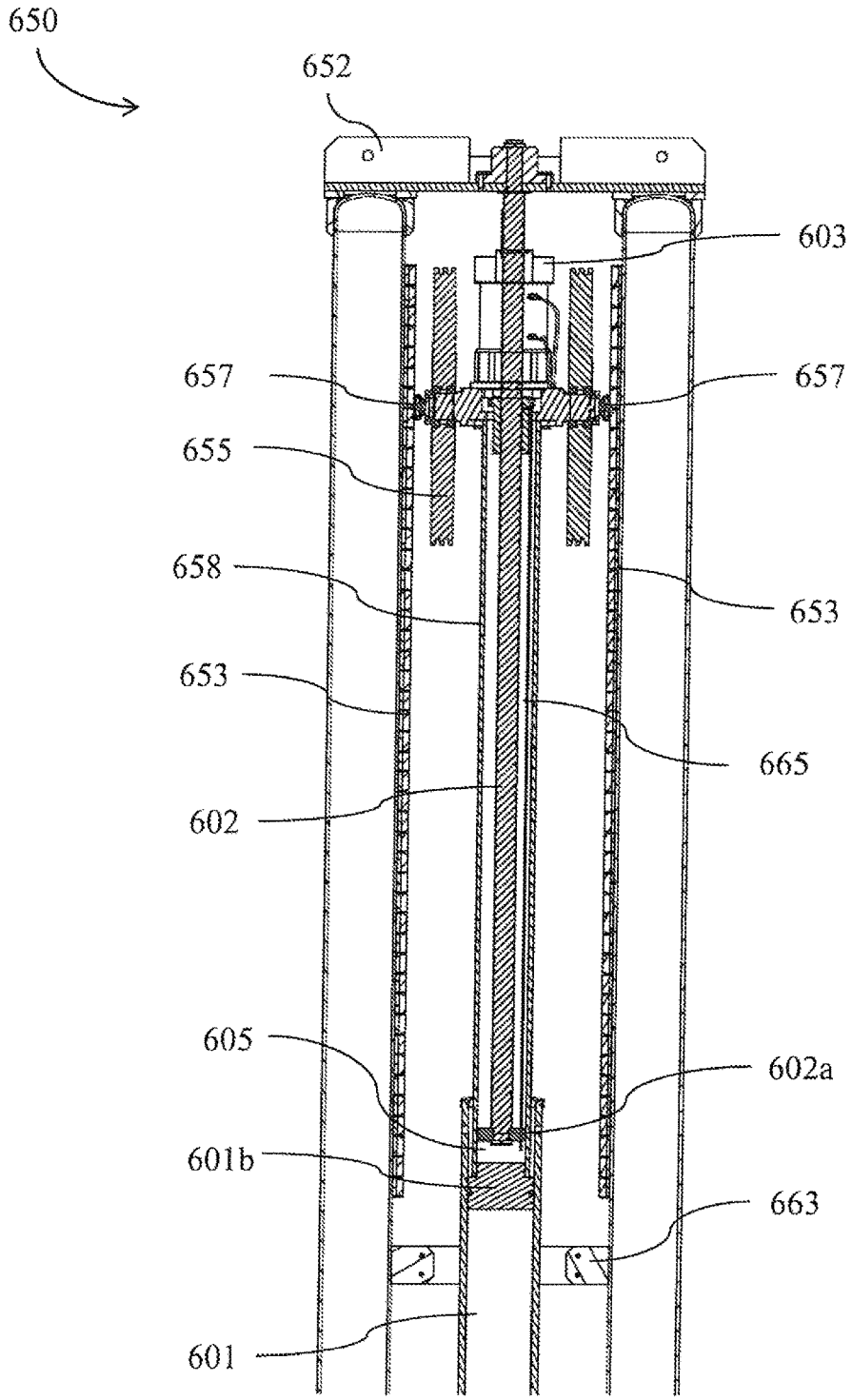
FIG. 3 shows a second schematic view of the upper part of a first embodiment of the pumping machine, according to the invention.

With reference to these figures, and in particular to FIGS. 2 and 3, a pumping machine is shown, according to the invention. More in details, a first embodiment of the pumping machine 650 comprises two tubular elements 651 extending vertically and parallel to each other and which act as containers, or accumulators, of gas under pressure, for example nitrogen or a mixture of air and nitrogen, inserted through appropriate valves not shown in the figure. The tubular elements 651 are superiorly interconnected each other by a connecting element 652, for example a bracket, and inferiorly fixed to a support structure, shown in FIG. 4, such as a stand. The machine 650 also comprises rolling means 655, for example pulleys adapted to support a cable for lifting a load, attached to sliding means 657 sliding in guides 653 which are internal to the tubular elements 651 and extending for a predetermined length along these.

Moreover, the machine 650 comprises, between the two tubular elements 651, an electro-mechanical lifting system 600 comprising a first cylinder 601, to which the tubular elements 651 are interconnected via a connecting element 663 and flexible hoses that allow the passage of gas between the tubular elements 651 and the cylinder 601. In this way, the cylinder 601 is filled with compressible gas, coming from the tubular elements 651, and comprises a piston 601*b* configured to compress the gas. The electromechanical lifting system 600 also comprises a screw 602 whose end 602*a* is inserted inside a second thrust cylinder 658 connected in sliding manner, at a screw lower end, to inner walls of the first cylinder 601.

Advantageously according to the invention, the gas load is transmitted to the pulleys of the machine solely via the thrust cylinder 658.

The lower portion of the thrust cylinder 658 inserted inside the first cylinder 601 houses a chamber 605 collecting a lubrication and cooling oil that is used to lubricate and cool a nut 603*b*, the screw 602 and the inner of the thrust cylinder 658, in particular in the first embodiment of the machine in which the thrust cylinder 658 comprises a lower support 660, shown in FIG. 2, configured to limit the vibrations and bending of the free end of the screw. Moreover, the thrust cylinder 658 comprises a suction tube 665 for suction of the oil contained in the chamber 605, as shown in FIG. 2, or, alternatively external to it.

Figure 4:
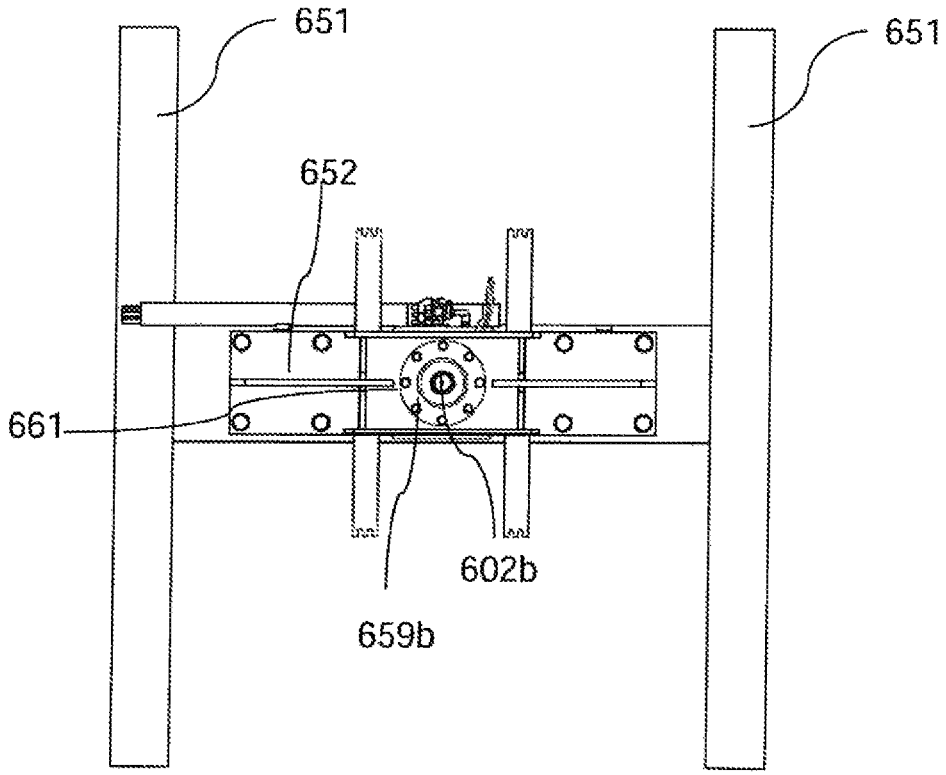
FIG. 4 shows a schematic top view of the upper part of the first embodiment of the pumping machine, according to the invention.

The screw 602 has a first end 602*b* secured to the connection element 652, by means of a first locking element, for example comprising a locking hub 661 and a first ring 659*b*, as shown in FIG. 4.

Figure 5:
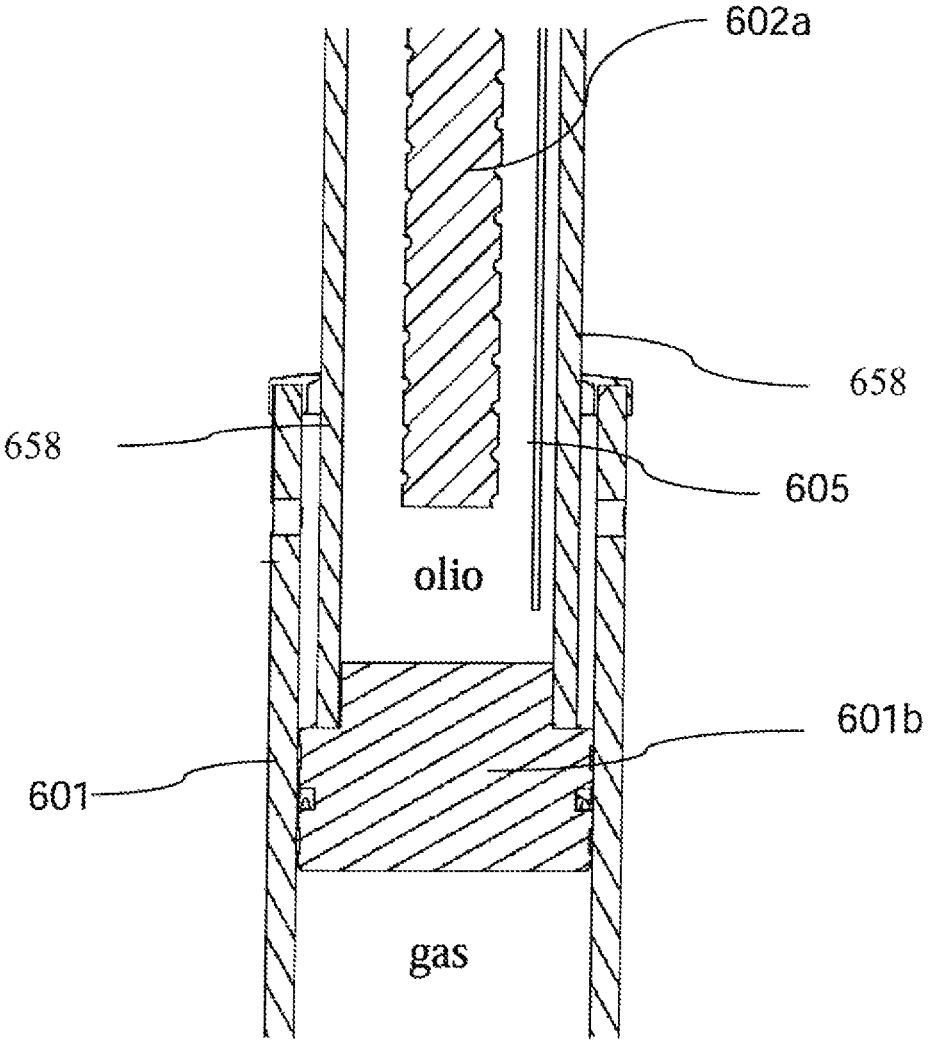
FIG. 5 shows a cross-section schematic view of the lower end of the screw according to the first embodiment of the pumping machine, according to the invention.

Furthermore, as shown in FIG. 5, in an inverted image of the cylinder 601, according to an aspect of the invention, the screw has a second free end 602*a* that, as shown in FIG. 2, is connected, by means of a second locking element, for example a second ring 659*a*, to the support 660, for example made of steel, sliding inside the thrust cylinder 658 and overlying the chamber 605 comprising the lubricating and cooling oil.

Advantageously according to the invention, the sliding support 660 allows the screw 602 to be guided and be able to take long runs.

Figure 6:
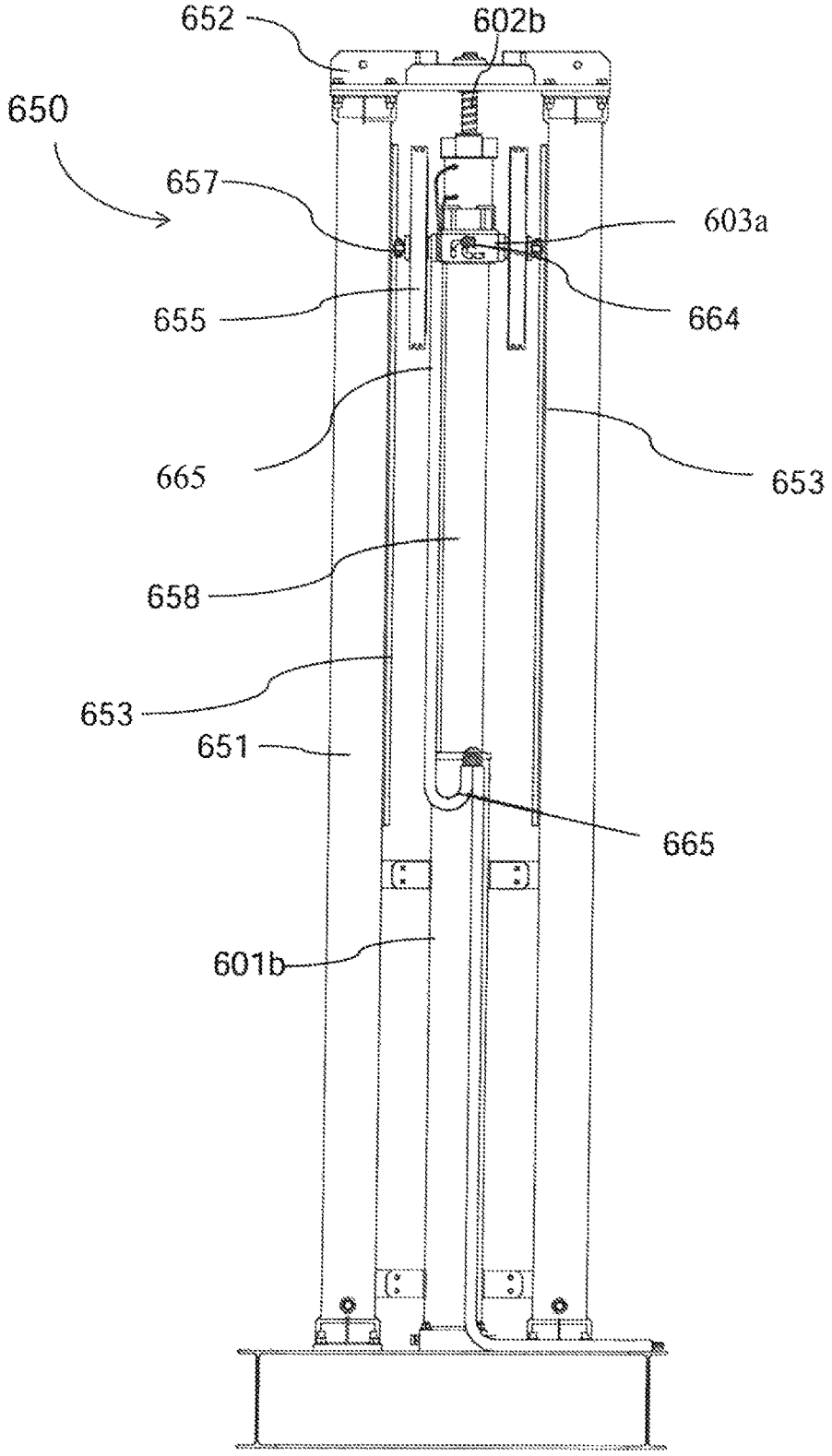
FIG. 6 shows a schematic sectional view of the first embodiment of the pumping machine, according to the invention.

Advantageously according to the invention, into the chamber 605 is possible to accumulate oil which, sucked by the pump 664 shown in FIG. 6, allows to lubricate and cool the nut 603*b* and lubricate the support 660 that acts as a bottom guide for the screw.

According to an aspect of the invention, the screw 602 is a ball screw, or roller, or roller satellites, or hydrostatic nut.

Figure 7:
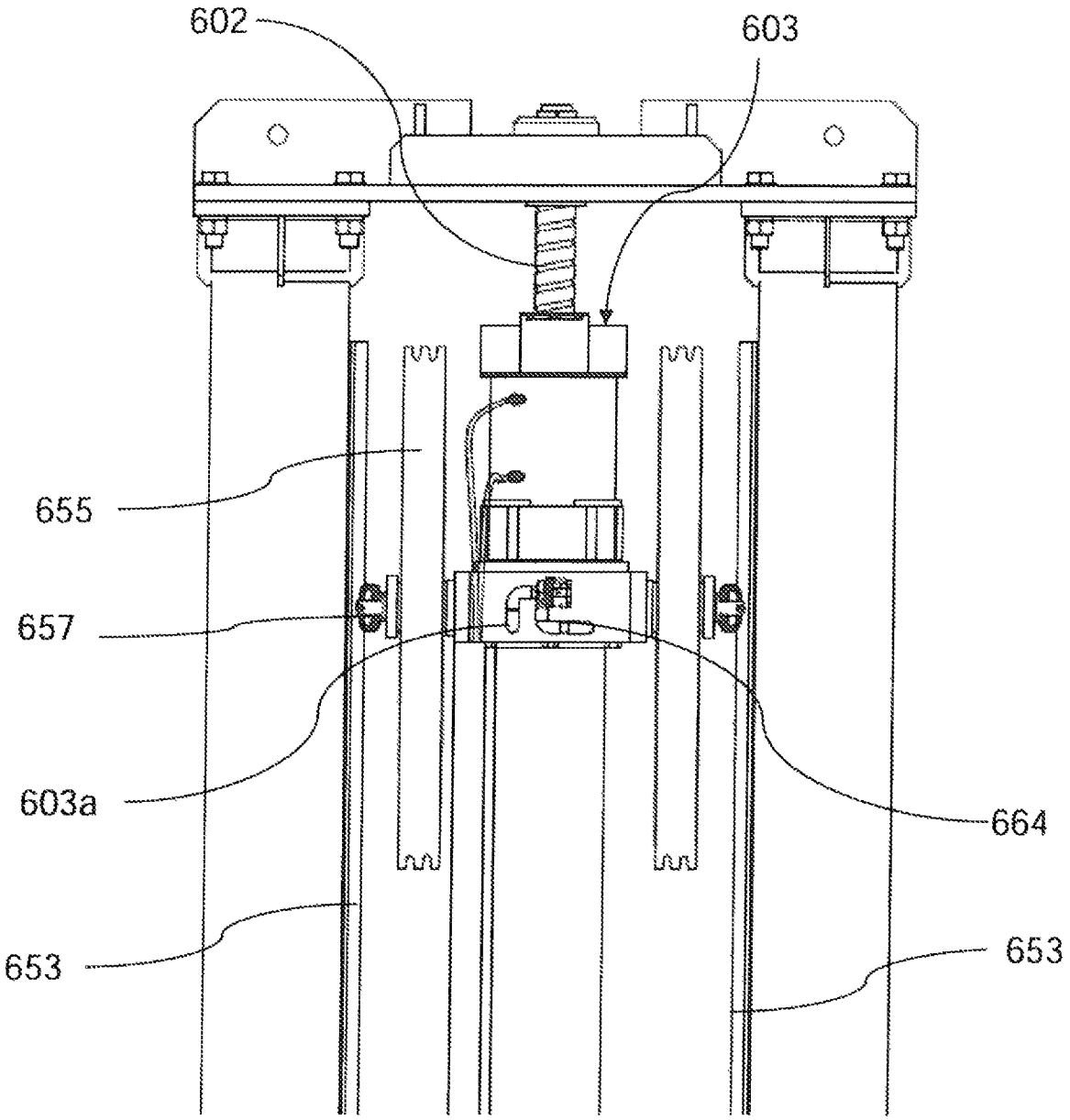
FIG. 7 shows a schematic view of the motor of the pumping machine, according to the invention.

The machine 600 also comprises the motor 603, better shown in FIG. 7, which has a stator supported by a carriage 603*a*, which also serves as head for supporting pulleys 655, and fixed to the sliding means 657 sliding in guides 653 placed on the inner walls of the tubular elements 651. In addition, the motor 603 comprises the nut 603*b*, that is recirculating balls and/or rollers or hydrostatic, and which is flanged to the rotor of the motor 603 rotating around the screw 602, or, alternatively, being a part of the motor itself.

Advantageously according to the invention, on the motor 603 an encoder, not shown in the figure, is arranged to indicate the position of the motor 603 to a control system, not shown in the figure. In addition, the motor 603 comprises extra-stroke safety sensors and feedback sensors, not shown in the figure, to have feedback on the position, speed and acceleration of the thrust cylinder 658. The control system is configured to continually monitor the performance of the pumping machine and to react to variable loads of the lifting rods and to the various environmental conditions.

Advantageously according to the invention, an oil pump 664 configured to lubricate and cool the nut and the screw is placed in the head 603*a*. The oil pump 664 is also configured to lubricate the inside of the thrust cylinder 658 and the sliding means 660, when present.

All the moving parts of the machine are lubricated and cooled, by means of a heat exchanger, not shown in the figure, so as to ensure the efficiency and functionality.

Advantageously according to the invention, the gas counter-balancing of the weight of the pumping rods, raised from the machine through the cables on the pulleys (the deeper a well the longest and heaviest are the rods), can be adjusted simply by acting on the gas pressure in the accumulators.

Figure 8:
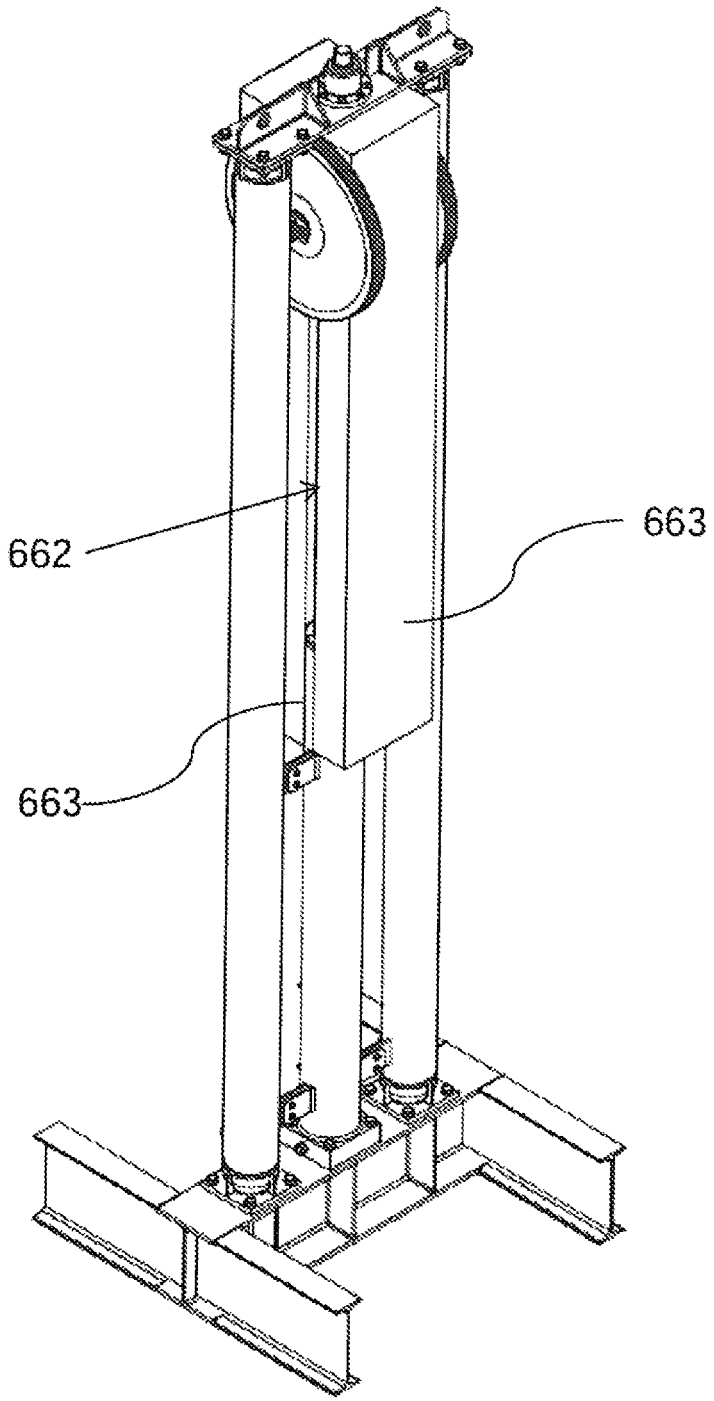
FIG. 8 shows a schematic view of a cover system of the screw incorporated into the upper part of the first embodiment of the pumping machine, according to the invention.

The machine 650 also comprises, as shown in FIG. 8, a cover system of the screw 602. More precisely, the screw cover system 602 comprises two sliding plates 662 sliding on inner guides, not shown in the figure and arranged laterally to the screw 602, and fixed plates 663 as front and rear cover of the screw 602.

Advantageously according to the invention, the screw cover system 602 also protects the motor 603, the catenary 665 with the flexible hoses, the lubrication pump 664 and all the sensors present.

Figure 9A:
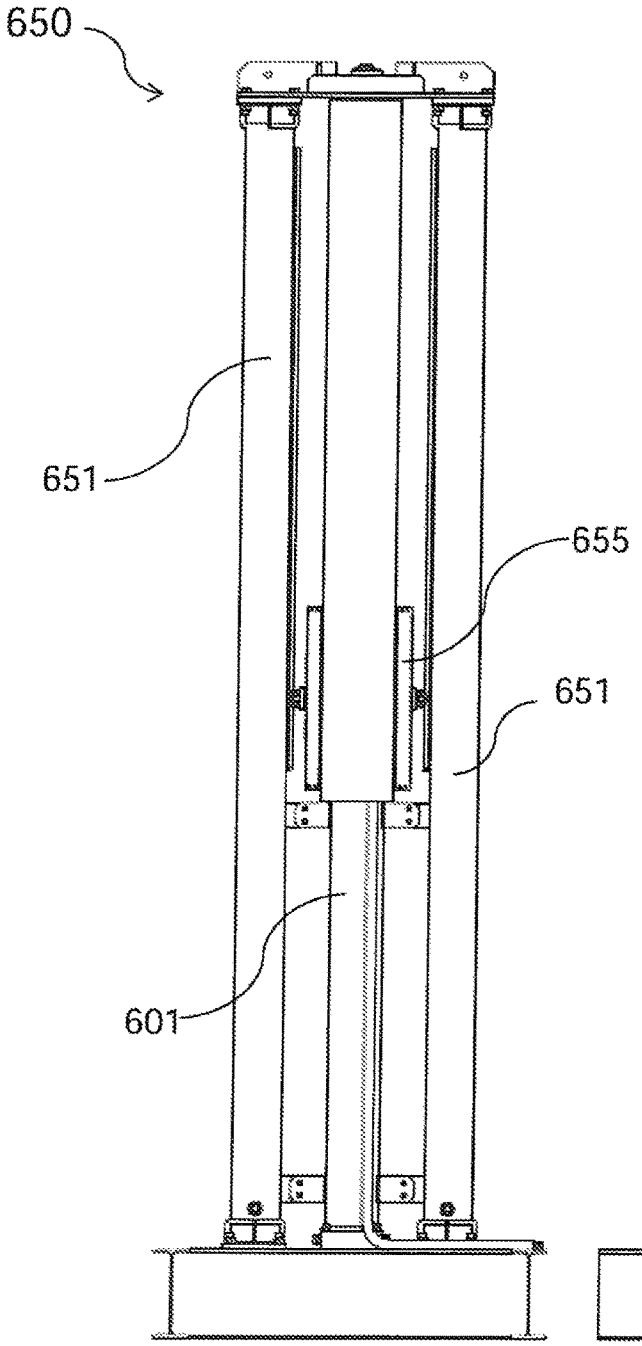
FIGS. 9A-9B show front and lateral schematic views of the first embodiment of the pumping machine at rest in a starting configuration, according to the invention.
Figure 9B:
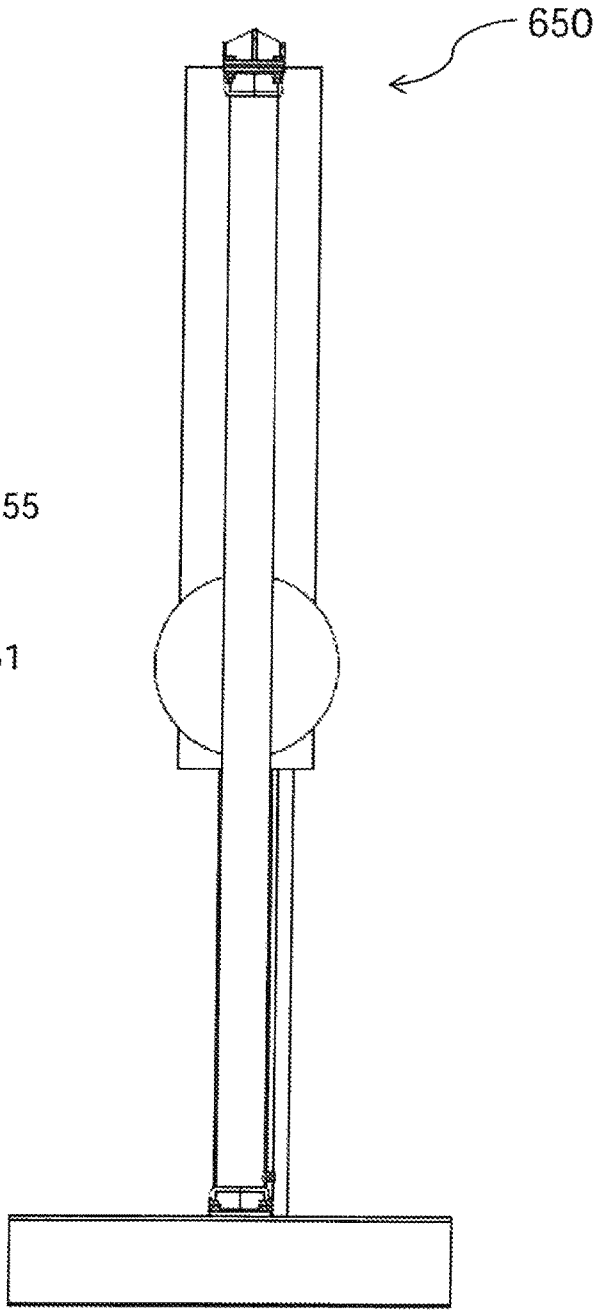
Figure 10:
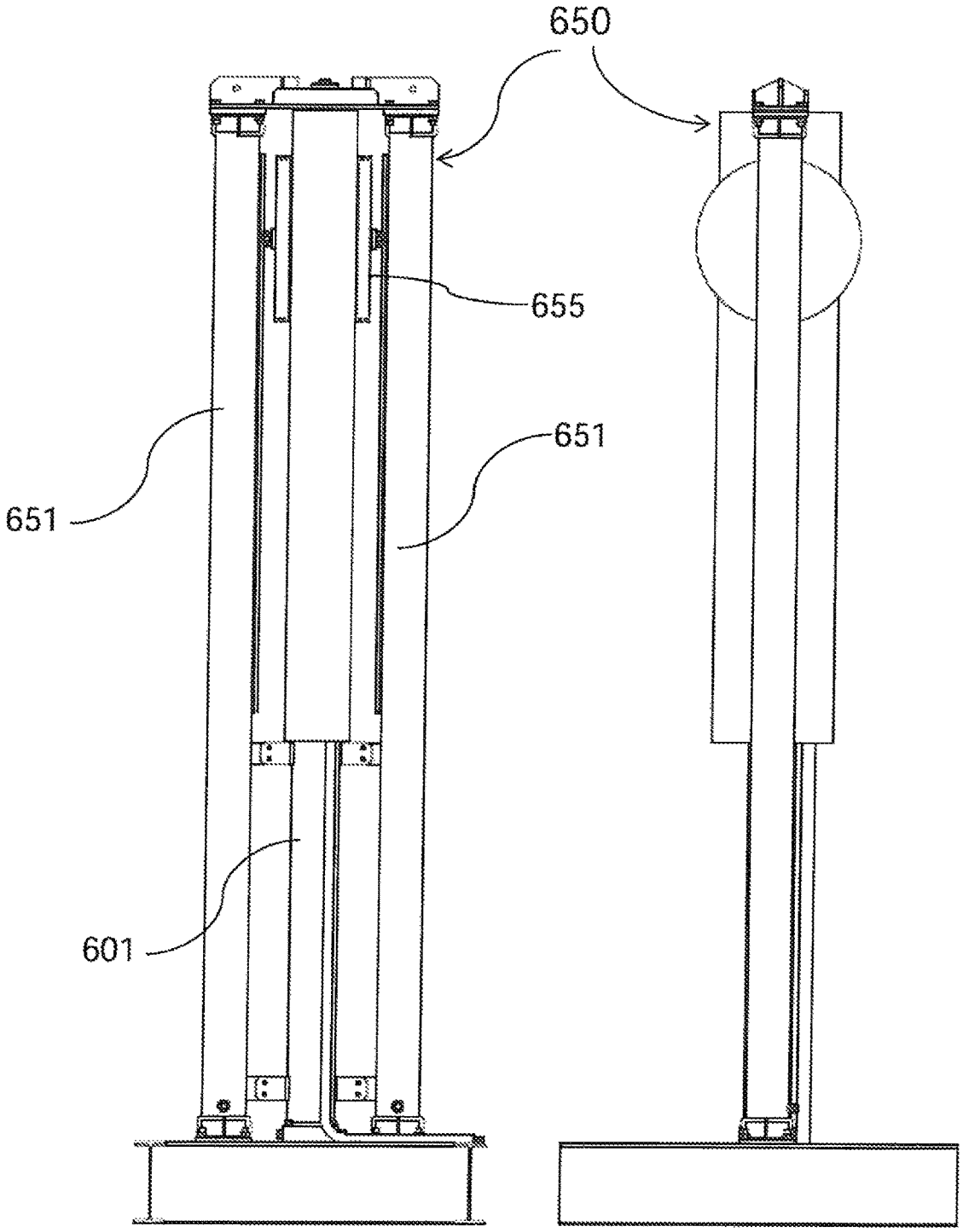
FIGS. 10A-10B show front and lateral schematic views of the first embodiment of the pumping machine in a final operation configuration, according to the invention.

In use, in the initial configuration, the machine 650 has the pulleys 655 in the lower part of the machine 650, as shown in FIG. 9. In this configuration, the gas is contained in the tubular elements 651 in communication with the first cylinder 601 and from here pushes on the piston 601*b* and on the inner tube 658 fixed thereto, lightening the load to be lifted by means of the electric motor 603. Consequently, the pulleys 655 are pushed to rise lightening the load, hooked with cables to the pulleys 655. Subsequently, the electric motor 603 rotates the nut 603*b* which drives up the load. Then the motor 603 performs a rising ramp followed by a deceleration ramp up to reach the upper part of the machine 650. In this and position, shown in FIG. 10, the motor 603 makes a U-turn and causes the screw 602 to compress the gas, helped by the load. Therefore, the gas acts as balancing element for the motor, allowing energy saving.

Figures 11A, 11B:
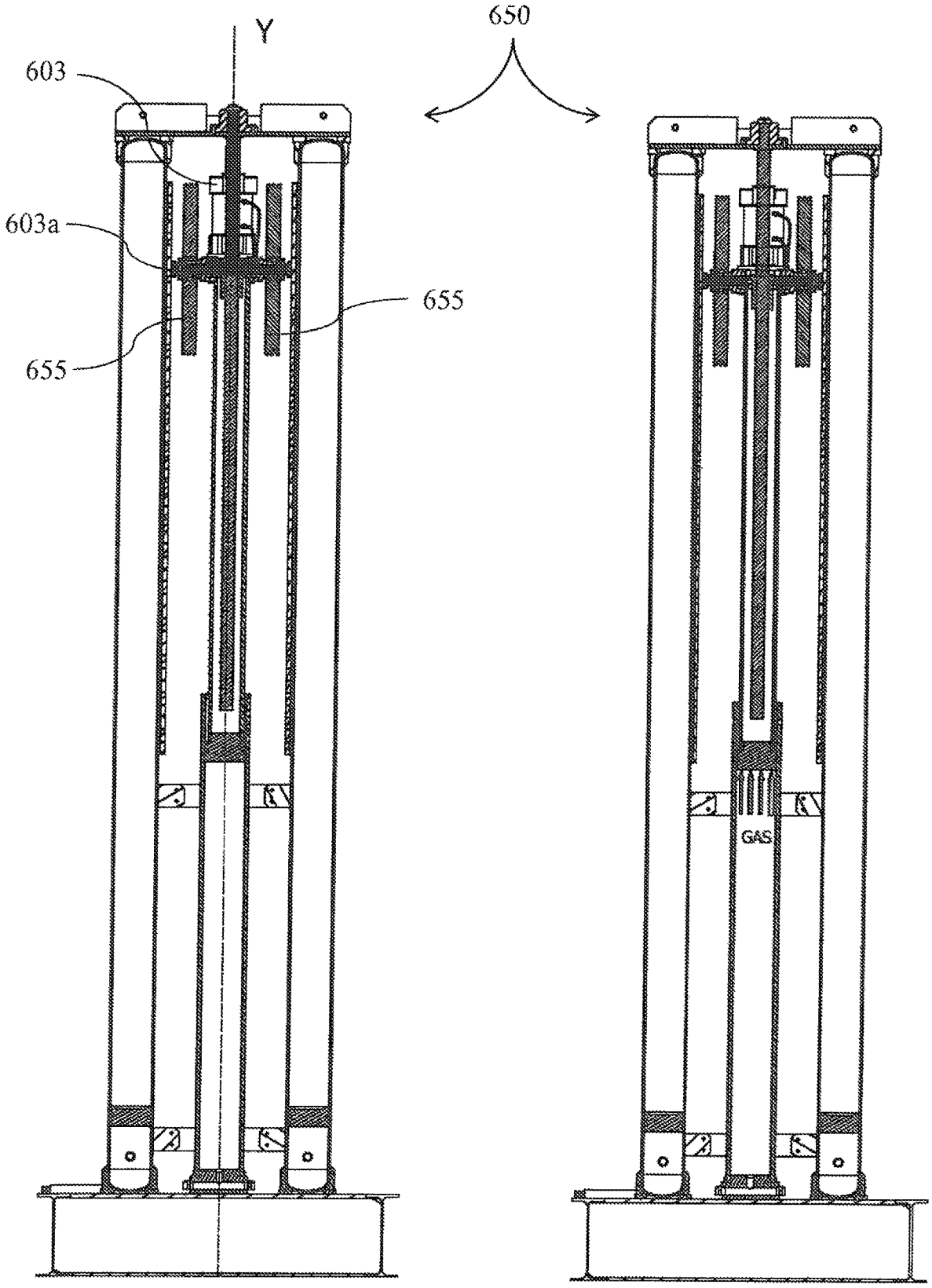
FIG. 11 shows a schematic cross-section view of the first embodiment of the pumping machine with a schematization of the involved forces, according to the invention.

As shown schematically in FIG. 11, advantageously according to the invention, during the ascent motion along the Y axis of the screw 602, which is also the operation of the machine axis 600, the action of the electric motor 603 is transmitted to the pulleys 655 of the machine 605 interconnected with the head 603*a* only via the torque transmitted to the nut 603*b*, which, being recirculating balls and/or rollers, or hydrostatic, in turn rotates around the screw 602 transforming the rotary motion into a rectilinear motion along the Y axis. In particular, the left image of FIG. 11 shows the distribution of the force exerted by the motor and the right image shows the distribution of the force exerted by the gas. In this way, it is evident that not all the action of forces of the engine and of the gas transfers to the nut, but follows two different paths.

Advantageously, according to the invention, during the descent motion along the Y axis, the action of the electric motor 603 is transmitted to the gas. In fact, the piston 601*b* is actuated by the thrust cylinder 658, which is located in a lower position with respect to the head 603*a*, exclusively by means of the torque transmitted to the nut 603*b*, which in turn rotates around the screw 602 transforming the rotary motion into a rectilinear motion along the Y axis.

Figure 12:
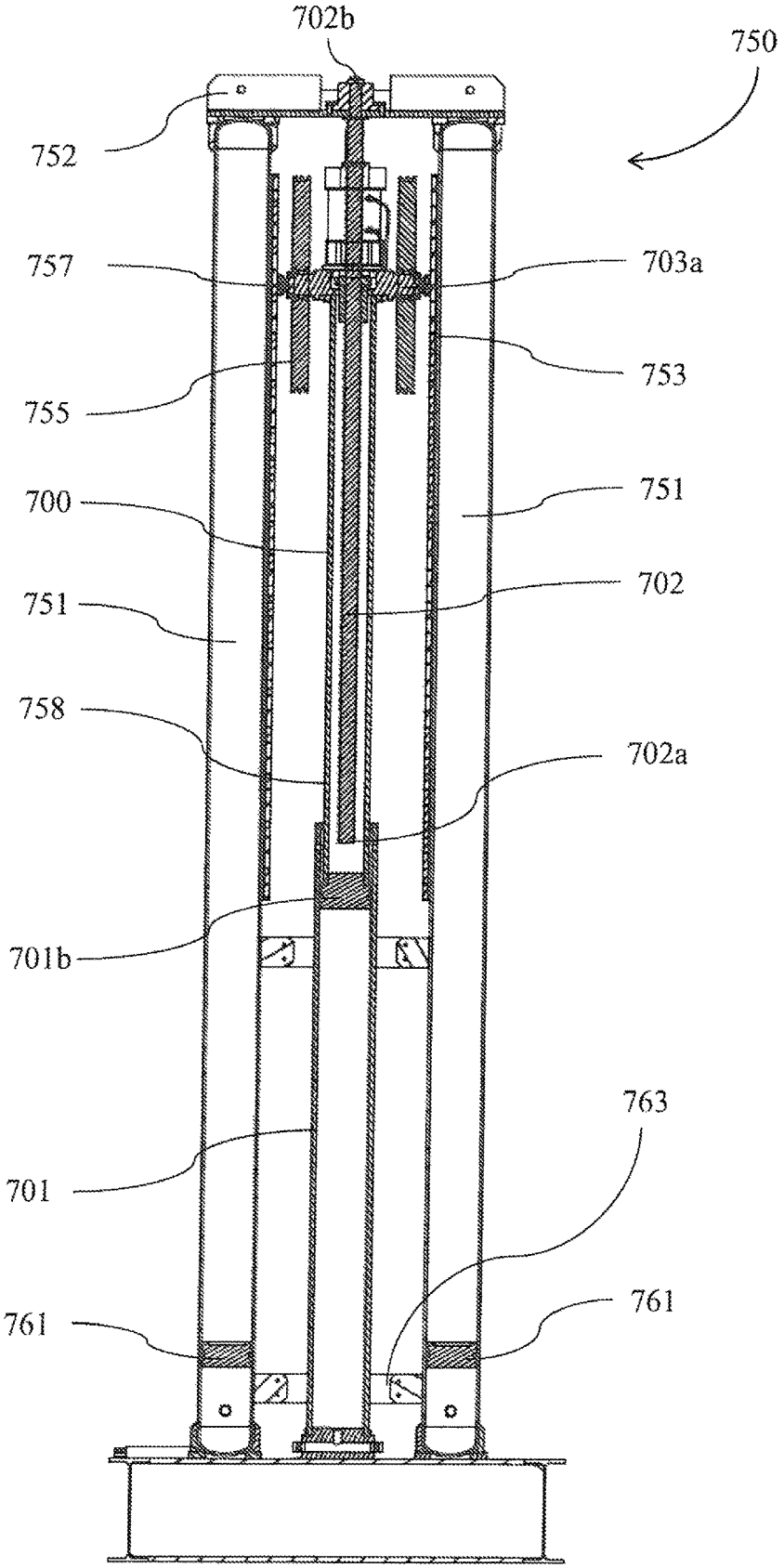
FIG. 12 shows a schematic cross-section view of a second embodiment of the pumping machine, according to the invention.

According to an aspect of the invention, as shown in FIG. 12, the machine 750 comprises oil, instead of the gas, inside the cylinder 701 placed in communication with a lower portion of the tubular elements 751 containing oil and inside of which separator floating pistons 761 are located. The pistons 761 are configured to separate the oil from the gas contained in the upper portions of the tubular elements 751.

According to another aspect of the invention, the tubular elements 751 are devoid of separator floating pistons and, in such case, the separation between gas and oil is carried out using the two different physical states liquid/gas.

Therefore, the pumping machine according to the invention allows to lift higher loads compared to the machine of the previous patent application of the Applicant.

Another advantage of the pumping machine according to the invention consists in the increase of its life.

Another advantage of the pumping machine according to the invention consists in the fact that by means of the oil lubrication that also acts as a cooling it's possible to monitor the operation condition, using the appropriate sensors on the fluid.

Furthermore, the pumping machine according to the invention allows to obtain a precise handling.

Another advantage of the pumping machine according to the invention is the increased operation speed.

Finally, the pumping machine according to the invention has a low noise level.

Finally it is clear that the pumping machine described and illustrated here can be modified and varied without departing from the protective scope of the present invention, as defined in the appended claims.

The invention claimed is:

1. A pumping machine comprising:

at least two tubular elements containing pressurized gas and extending vertically in parallel and interconnected between them by means of a connecting element; and an electromechanical lifting system comprising a first cylinder, interconnected to the tubular elements and comprising a substance compressible by a piston; and a screw with a vertical axis Y coinciding with an axis of the pumping machine;

wherein the screw is inserted inside a second thrust cylinder, connected in sliding manner inside the first cylinder, and has a first end fixed to said connecting element and a second end configured for sliding inside said second thrust cylinder and overlying a chamber comprising lubrication and cooling oil overlying said piston.

2. The pumping machine according to claim 1, wherein said screw is a recirculating ball screw, or ball roller screw, or satellites roller screw, or hydrostatic nut screw.

3. The pumping machine according to claim 1, wherein said first end is fixed to said connecting element by means of first locking means.

4. The pumping machine according to claim 1, wherein it comprises a suction tube of the oil contained in the chamber.

5. The pumping machine according to claim 1, wherein it comprises an electric motor able to move downhill and uphill along the screw and comprising a stator supported by a head for holding pulleys, and fixed to a sliding means configured for sliding inside guides on the internal walls of the tubular elements, and a recirculating ball and/or rollers or hydrostatic nut.

6. The pumping machine according to claim 5, wherein said nut is flanged to the rotor of the motor rotating around the screw or is integrated to the motor.

7. The pumping machine according to claim 1, wherein it comprises a cover system for covering the screw configured to protect the screw and the motor.

8. The pumping machine according to claim 1, wherein said second end is free.

9. The pumping machine according to claim 8, wherein said second end is connected, by second locking means, to a support overlying said chamber and configured to slide within said thrust cylinder.

10. The pumping machine according to claim 1, wherein said substance compressible by a piston is gas or oil.

11. The pumping machine according to claim 1, wherein said tubular elements comprise the pressurized gas in their upper portions and oil in their lower portions.

12. The pumping machine according to claim 11, wherein said tubular elements comprise floating separator pistons configured to separate the oil from the gas.

* * * * *